US008958731B2

(12) United States Patent
Ouchi et al.

(10) Patent No.: US 8,958,731 B2
(45) Date of Patent: Feb. 17, 2015

(54) ROTATION SHAFT COUPLING STRUCTURE, INTERMEDIATE TRANSFER UNIT INCLUDING THE SAME, AND IMAGE FORMING APPARATUS

(71) Applicant: Fuji Xerox Co., Ltd., Minato-ku, Tokyo (JP)

(72) Inventors: Akihiro Ouchi, Kanagawa (JP); Kazuyuki Yagata, Kanagawa (JP); Yoshihiro Enomoto, Kanagawa (JP); Kenji Suzuki, Kanagawa (JP); Yoshiya Mashimo, Kanagawa (JP); Shinichi Kanaya, Kanagawa (JP); Mitsuaki Kuroda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 168 days.

(21) Appl. No.: 13/646,048

(22) Filed: Oct. 5, 2012

(65) Prior Publication Data

US 2013/0223894 A1 Aug. 29, 2013

(30) Foreign Application Priority Data

Feb. 29, 2012 (JP) ..... 2012-044018

(51) Int. Cl.
*G03G 15/00* (2006.01)
*G03G 15/01* (2006.01)

(52) U.S. Cl.
USPC ..... 399/302; 399/167

(58) Field of Classification Search
USPC ..... 399/167, 302
See application file for complete search history.

(56) References Cited

U.S. PATENT DOCUMENTS

| | | | | | |
|---|---|---|---|---|---|
| 4,345,834 | A * | 8/1982 | Kimura et al. | ..... | 399/167 |
| 5,023,660 | A * | 6/1991 | Ebata et al. | ..... | 399/111 |
| 5,065,676 | A * | 11/1991 | Hardin | ..... | 101/350.3 |
| 5,371,576 | A * | 12/1994 | Gonda | ..... | 399/167 |
| 5,993,101 | A * | 11/1999 | Kohno et al. | ..... | 403/305 |
| 6,438,341 | B1 * | 8/2002 | Matsuoka | ..... | 399/117 |
| 6,556,796 | B1 * | 4/2003 | Chavez et al. | ..... | 399/110 |

(Continued)

FOREIGN PATENT DOCUMENTS

| | | | |
|---|---|---|---|
| GB | 2141520 | A * | 12/1984 |
| JP | 63008654 | A * | 1/1988 |

(Continued)

OTHER PUBLICATIONS

Machine translation of JP 2005309060 A.*
English abstract of JP 63008654 A.*

*Primary Examiner* — David Bolduc
(74) *Attorney, Agent, or Firm* — Sughrue Mion, PLLC

(57) ABSTRACT

A rotation shaft coupling structure includes a roller drive shaft including a recessed portion having an internal thread; a rotation roller including a coupling member housing the recessed portion of the roller drive shaft; and a coupling shaft extending through the rotation roller in the axial direction. The coupling shaft includes a threaded portion at a first end portion thereof, the threaded portion mating with the internal thread of the recessed portion, and the coupling shaft couples the roller drive shaft and the rotation roller to each other. The first end portion of the coupling shaft in the axial direction is joined to the roller drive shaft and the rotation roller in the coupling member of the rotation roller, and a second end portion of the coupling shaft in the axial direction is a free end that allows the coupling shaft to extend and contract in the axial direction.

6 Claims, 5 Drawing Sheets

(56) References Cited

U.S. PATENT DOCUMENTS

| | | | | |
|---|---|---|---|---|
| 7,224,924 | B2 * | 5/2007 | Okamoto | 399/119 |
| 7,401,555 | B2 * | 7/2008 | Ono et al. | 101/480 |
| 7,865,112 | B2 * | 1/2011 | Saito et al. | 399/117 |
| 2007/0025788 | A1 * | 2/2007 | deJong et al. | 399/388 |
| 2008/0175612 | A1 * | 7/2008 | Oikawa et al. | 399/66 |
| 2010/0221041 | A1 * | 9/2010 | Takai et al. | 399/159 |
| 2012/0027461 | A1 * | 2/2012 | Murai et al. | 399/121 |
| 2012/0237257 | A1 * | 9/2012 | Tomino et al. | 399/121 |

FOREIGN PATENT DOCUMENTS

| | | | |
|---|---|---|---|
| JP | 2002162866 | A * | 6/2002 |
| JP | 2005-309060 | A | 11/2005 |

* cited by examiner

ROTATION SHAFT COUPLING STRUCTURE, INTERMEDIATE TRANSFER UNIT INCLUDING THE SAME, AND IMAGE FORMING APPARATUS

CROSS-REFERENCE TO RELATED APPLICATIONS

This application is based on and claims priority under 35 USC 119 from Japanese Patent Application No. 2012-044018 filed Feb. 29, 2012.

BACKGROUND

Technical Field

The present invention relates to a rotation shaft coupling structure, an intermediate transfer unit including the rotation shaft coupling structure, and an image forming apparatus.

SUMMARY

According to an aspect of the invention, a rotation shaft coupling structure includes a roller drive shaft that is rotatable and that includes a recessed portion at an end thereof, the recessed portion having an internal thread formed therein; a rotation roller having a hollow shape and including a coupling member at an end portion thereof in an axial direction, the coupling member housing the recessed portion of the roller drive shaft, the rotation roller being rotated by the roller drive shaft; and a coupling shaft extending through the rotation roller in the axial direction and including a threaded portion at a first end portion thereof in the axial direction, the threaded portion mating with the internal thread of the recessed portion, the coupling shaft coupling the roller drive shaft and the rotation roller to each other. The first end portion of the coupling shaft in the axial direction is joined to the roller drive shaft and the rotation roller in the coupling member of the rotation roller, and a second end portion of the coupling shaft in the axial direction is a free end that allows the coupling shaft to extend and contract in the axial direction.

BRIEF DESCRIPTION OF THE DRAWINGS

An exemplary embodiment of the present invention will be described in detail based on the following figures, wherein.

DETAILED DESCRIPTION

Hereinafter, an exemplary embodiment of the present invention will be described with reference to the drawings.

Figure 1:
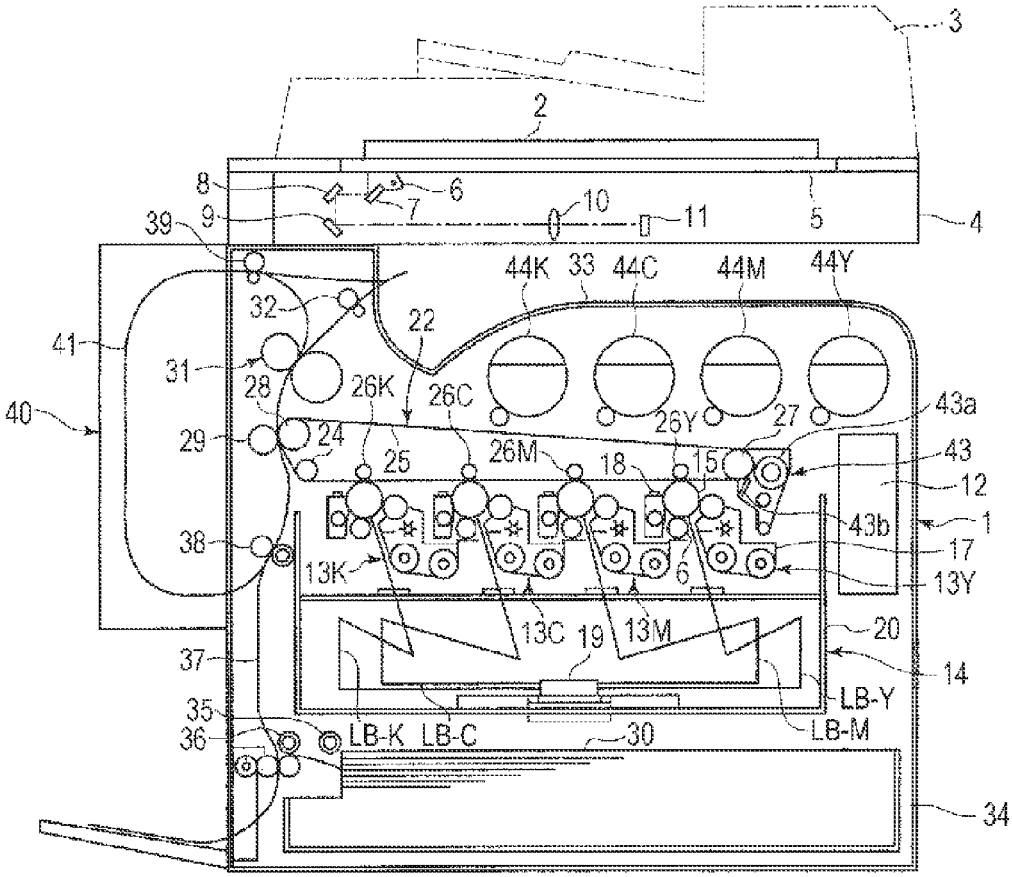
FIG. 1 is a schematic view illustrating an image forming apparatus according to the present exemplary embodiment.

Referring to FIG. 1, an image forming apparatus to which the exemplary embodiment of present invention is applicable will be described. FIG. 1 is a schematic view illustrating a tandem-type digital color copier, which is an example of an image forming apparatus to which the present exemplary embodiment is applicable. The tandem-type color digital copier includes an image reading device. However, the image forming apparatus may be a color printer, a facsimile, or the like that does not include an image reading device and forms an image on the basis of image data output from a personal computer or the like (not shown).

As illustrated in FIG. 1, the tandem-type digital color copier includes a body 1; and an automatic document transport device 3 and a document reading device 4, which are disposed above the body 1. The automatic document transport device 3 automatically transports documents 2 one by one. The document reading device 4 reads an image of the document 2 transported by the automatic document transport device 3. The document reading device 4 irradiates the document 2 placed on a platen glass 5 with light emitted from a light source 6; exposes an image reading element 11, such as a charge coupled device (CCD), to reflected color light image from the document 2 in a scanning manner through a reducing optical system including a full-rate mirror 7, half-rate mirrors 8 and 9, and an imaging lens 10; and reads the reflected color light image of the document 2 with a predetermined dot density (for example, 16 dots/mm) by using the image reading element 11.

The reflected color light image of the document 2, which has been read by the document reading device 4, is sent to an image processor 12 in the form of document reflectance data for, for example, three colors that are red (R), green (G), and blue (B) (8 bits for each color). On the reflectance data of the document 2, the image processor 12 performs image processing such as shading correction, correction of position displacement, brightness/color space conversion, gamma correction, frame erasing, and color/movement edition. The image processor 12 also performs predetermined image processing on image data sent from the personal computer or the like.

The image data, on which the image processor 12 has performed the predetermined image processing as described above, is converted to document color gradation data (raster data) for yellow (Y), magenta (M), cyan (C), and black (K) (each 8 bits). The raster data is sent to an exposure device 14, which is shared by image forming units 13Y, 13M, 13C, and 13K for yellow (Y), magenta (M), cyan (C), and black (K). The exposure device 14 performs image exposure in accordance with document color gradation data for respective colors by using laser beams LB.

The image forming apparatus according to the present exemplary embodiment further includes the image forming units 13Y, 13M, 13C, and 13K; an intermediate transfer belt 25; and the exposure device 14. The image forming units 13Y, 13M, 13C, and 13K are parallelly arranged and form images in corresponding colors. The intermediate transfer belt 25 is disposed above the image forming units 13Y, 13M, 13C, and 13K; and color toner images formed by the image forming units 13Y, 13M, 13C, and 13K are transferred to the intermediate transfer belt 25. The exposure device 14 is disposed below the image forming units 13Y, 13M, 13C, and 13K; and forms an image on photoconductor drums 15Y, 15M, 15C, and 15K of the image forming units 13Y, 13M, 13C, and 13K.

Figure 2:
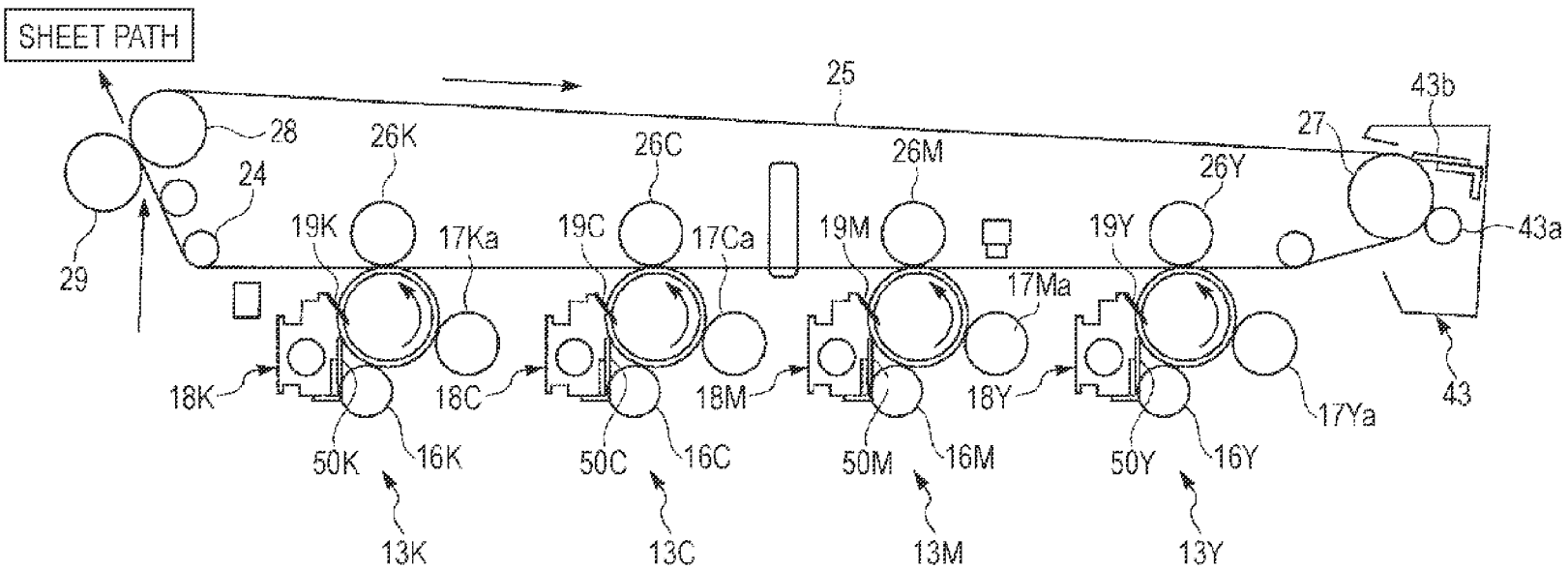
FIG. 2 is a schematic enlarged view illustrating image forming units according to the present exemplary embodiment.

Referring to FIG. 2, components of the image forming units 13Y, 13M, 13C, and 13K will be described. FIG. 2 is a schematic enlarged view illustrating the image forming units 13Y, 13M, 13C, and 13K.

As illustrated in FIG. 2, the four image forming units 13Y, 13M, 13C, and 13K corresponding to yellow (Y), magenta (M), cyan (C), and black (K) are parallelly arranged at a regular pitch in a horizontal direction in which the intermediate transfer belt 25 moves. The intermediate transfer belt 25 has an endless shape and is looped over plural span rollers. The image forming units 13Y, 13M, 13C, and 13K successively form yellow, magenta, cyan, and black toner images, respectively, at predetermined timings. Since the image forming units 13Y, 13M, 13C, and 13K have the same structure, the same components of the image forming units will be collectively denoted by only a numeral (for example, "photoconductor drum 15").

Each of the image forming units 13Y, 13M, 13C, and 13K includes a photoconductor drum 15, a charger 16, a developing device 17, a drum cleaning device 18, and an erase lamp 50. The photoconductor drum 15, which is an example of an image carrier, is rotated in the direction of an arrow at a predetermined speed (for example, 200 mm/sec). The charger 16, which is an example of a charging unit, uniformly charges the surface of the photoconductor drum 15. The surface of the photoconductor drum 15 is exposed to light image in the corresponding color by the exposure device 14, which is an example of an exposure unit, and thereby an electrostatic latent image is formed. The developing device 17, which is an example of a developing unit, develops the electrostatic latent image formed on the photoconductor drum 15 by using a color toner. The drum cleaning device 18, which is an example of a cleaning unit, cleans the surface of the photoconductor drum 15. The erase lamp 50, which is an example of an erasing unit, exposes the entire surface of the photoconductor drum 15, before being charged, to light so as to eliminate the influence of the latent image formed by the exposure unit. In the present exemplary embodiment, each of the photoconductor drums 15 and the components surrounding the photoconductor drum 15 are integrated into a unit, which is removable from the body 1.

The photoconductor drum 15 includes an electroconductive metal cylinder and functional layers (photosensitive layers) stacked on the surface (outer peripheral surface) of the metal cylinder. The functional layers include, for example, a charge generation layer, which is made of an organic photoconducting material and the like, and a charge transport layer. The photoconductor drum 15 is rotated by a driving unit (not shown) in the direction of an arrow (in this example, counterclockwise in FIG. 1).

The charger 16 is formed as a charging roller including, for example, a metal core and an electroconductive layer that covers the metal core. The electroconductive layer is made of a synthetic resin or a rubber and has an appropriately adjusted electrical resistance. A charging bias power supply (not shown) is connected to the metal core of the charger 16, and a predetermined charging bias is applied to the metal core.

The exposure device 14 is shared by the image forming units 13Y, 13M, 13C, and 13K for yellow (Y), magenta (M), cyan (C), and black (K). The exposure device 14 modulates four semiconductor lasers (not shown) in accordance with document color gradation data for respective colors and causes the semiconductor lasers to emit laser beams LB-Y, LB-M, LB-C, and LB-K in accordance with the gradation data. The laser beams LB-Y, LB-M, LB-C, and LB-K emitted from the semiconductor lasers pass through an f-θ lens (not shown) to a rotatable polygon mirror 19 and are deflectively scanned by the rotatable polygon mirror 19. The laser beams LB-Y, LB-M, LB-C, and LB-K, which have been deflectively scanned by the rotatable polygon mirror 19, are reflected by plural reflection mirrors (not shown). The surfaces of the photoconductor drums 15Y, 15M, 15C, and 15K are exposed to the laser beams LB-Y, LB-M, LB-C, and LB-K in a scanning manner.

Alternatively, the exposure device 14 may be an LED array provided to each of the image forming units.

The image processor 12 successively outputs image data for respective colors to the exposure device 14, which is shared by the image forming units 13Y, 13M, 13C, and 13K for yellow (Y), magenta (M), cyan (C), and black (K). The surfaces of corresponding photoconductor drums 15 are exposed, in a scanning manner, to the laser beams LB-Y, LB-M, LB-C, and LB-K, which have been emitted from the exposure device 14 in accordance with image data, and thereby electrostatic latent images are formed. The electrostatic latent images formed on the photoconductor drums 15 are developed into to yellow (Y), magenta (M), cyan (C), and black (K) toner images by the developing devices 17.

The yellow (Y), magenta (M), cyan (C), and black (K) toner images, which have been successively formed on the photoconductor drums 15 of the image forming units 13Y, 13M, 13C, and 13K, are successively first-transferred onto the intermediate transfer belt 25 of an intermediate transfer unit 22 (a belt-shaped intermediate transfer member), which is disposed above the image forming units 13Y, 13M, 13C, and 13K, in an overlapping manner by four first transfer rollers 26Y, 26M, 26C, and 26K. The first transfer rollers 26Y, 26M, 26C, and 26K are respectively disposed opposite the photoconductor drums 15 of the image forming units 13Y, 13M, 13C, and 13K with the intermediate transfer belt 25 therebetween. Each of the first transfer rollers 26Y, 26M, 26C, and 26K has an appropriately adjusted volume resistivity. A transfer bias power supply (not shown) is connected to the first transfer rollers 26Y, 26M, 26C, and 26K, and a transfer bias having a polarity (in this example, positive polarity) opposite to that of toner is applied to the first transfer rollers 26Y, 26M, 26C, and 26K at predetermined timings.

The intermediate transfer belt 25 is looped over a drive roller 27, a tension roller 24, and a backup roller 28 with a predetermined tension. The drive roller 27 is rotated by a dedicated drive motor (not shown) that rotates at a highly constant speed. The intermediate transfer belt 25 is rotated by the drive roller 27 in the direction of an arrow at a predetermined speed. The intermediate transfer belt 25 is an endless-belt-shaped member made by, for example, connecting the ends of a strip of a flexible synthetic resin film, such as a PET film, by welding or the like.

The yellow (Y), magenta (M), cyan (C), and black (K) toner images, which have been transferred to the intermediate transfer belt 25 in an overlapping manner, are second-transferred onto a recording sheet 30, which is an example of a recording medium, by a second transfer roller 29, which is in pressed contact with the backup roller 28 disposed on a side surface of the intermediate transfer belt 25, by using a pressing force and an electrostatic attraction force. The recording sheet 30, onto which the color toner images have been transferred, is transported to a fixing device 31, which is disposed above the intermediate transfer belt 25.

After transfer of the toner images has been finished, remaining toner and paper powder are removed the surface of the intermediate transfer belt 25 by a belt cleaning device 43, which is disposed adjacent to the drive roller 27, to prepare for the next image forming process. The belt cleaning device 43 includes a cleaning brush 43*a* and a cleaning blade 43*b* that remove remaining toner and paper powder from the surface of the intermediate transfer belt 25.

The second transfer roller 29 is pressed against the backup roller 28 and second-transfers the color toner images onto the recording sheet 30, which is transported upward. The second transfer roller 29 includes, for example, a metal core made of a stainless steel and an elastic layer that covers the metal core with a predetermined thickness. The elastic layer is made of an electroconductive elastic material, such as a rubber material to which a conductive agent is added. The fixing device 31 performs a fixing operation on the recording sheet 30, onto which the color toner images have been transferred, with heat and pressure. Subsequently, the recording sheet 30 is output by an output roller 32 to an output tray 33 disposed on an upper part of the body 1.

The recording sheets 30 having a predetermined size are fed from a sheet feeding device 34 disposed in the apparatus body 1 after having been separated into an independent sheet by a nudger roller 35 and a separation roller 36. Then, the recording sheet 30 is temporarily transported to a registration roller 38 disposed in a sheet transport path 37 and then stopped. The recording sheet 30 fed from the sheet feeding device 34 is transported to a second transfer position of the intermediate transfer belt 25 by the registration roller 38, which is rotated at a predetermined timing.

When the digital color image forming apparatus according to the present exemplary embodiment makes two-sided copy of, for example, a full-color image, after an image has been formed on the recording sheet 30, the recording sheet 30 is not output by the output roller 32 to the output tray 33 but the transport direction of the recording sheet 30 is switched by a switching gate (not shown), and the recording sheet 30 is transported by using a pair of transport rollers 39 to a duplex transport unit 40. In the duplex transport unit 40, the recording sheet 30 is turned over by pairs of transport rollers (not shown) arranged along a transport path 41 and is transported to the registration roller 38 again. This time, an image is formed on the back side of the recording sheet 30, and then the recording sheet 30 is output to the output tray 33. Color toners in yellow (Y), magenta (M), cyan (C), and black (K) are supplied from toner cartridges 44Y, 44M, 44C, and 44K to the developing devices 17Y, 17M, 17C, and 17K.

In the present exemplary embodiment, the intermediate transfer belt 25, the drive roller 27, which drives and supports the intermediate transfer belt 25, and the tension roller 24 are integrated into the intermediate transfer unit 22, which is removable from the image forming apparatus body 1.

Referring to FIGS. 3 to 5B, a rotation shaft coupling structure according to the present exemplary embodiment will be described by using an example in which the structure is used for the drive roller 27 of the intermediate transfer belt 25.

Figure 3:
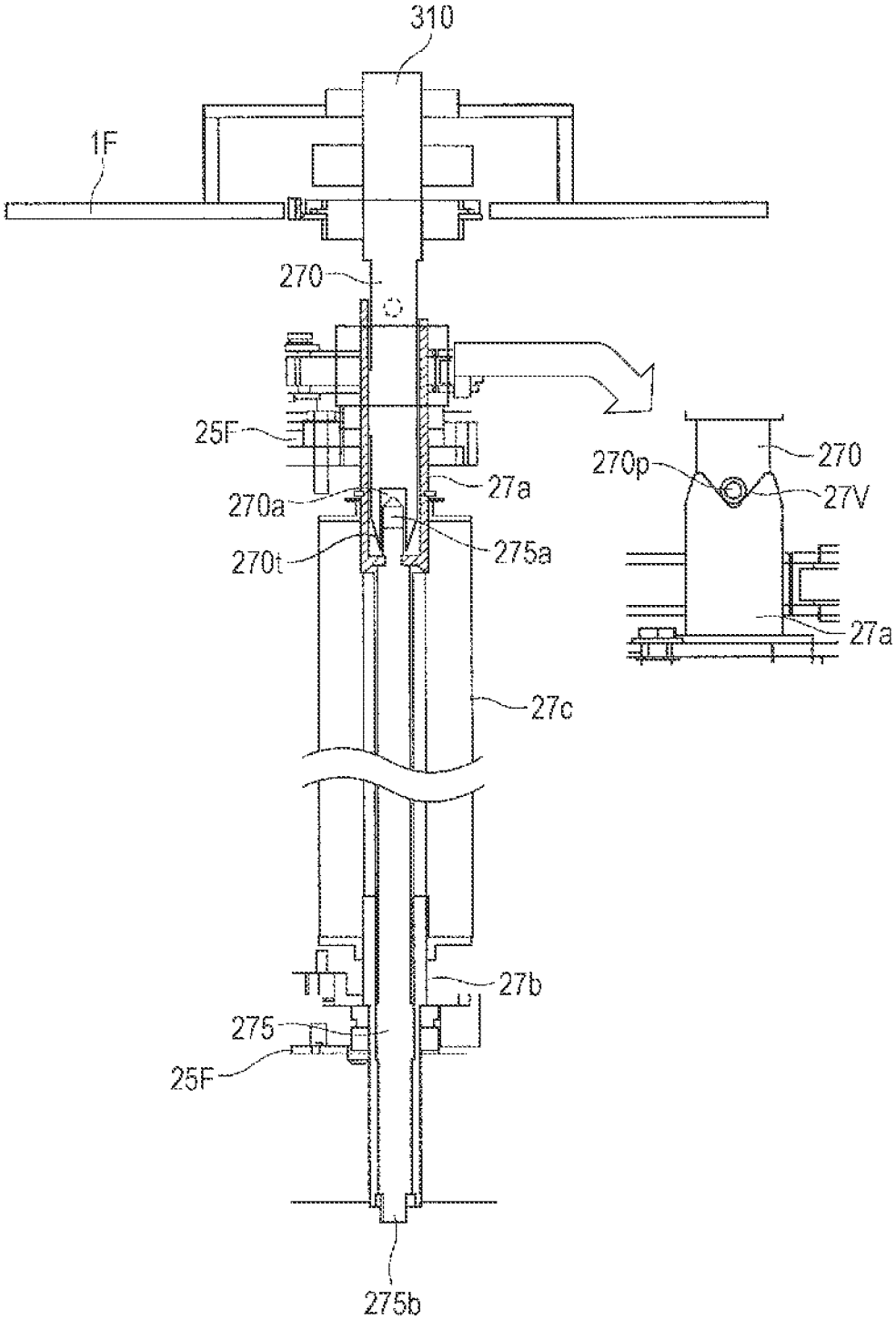
FIG. 3 is a schematic view illustrating a drive roller coupling structure according to the present exemplary embodiment.

FIG. 3 is a schematic view illustrating a structure for coupling a drive roller 27 according to the present exemplary embodiment. In the present exemplary embodiment, the drive roller 27 (rotation roller) of the intermediate transfer belt 25 has a hollow structure. The drive roller 27 is driven by a drive source, such as a drive motor 310, through a roller drive shaft 270, and thereby the intermediate transfer belt 25 is rotated at a predetermined speed.

To reduce weight, the drive roller 27 is made of, for example, aluminium and has a hollow cylindrical shape. To increase rigidity and wear resistance, the roller drive shaft 270, a coupling shaft 275, and the like are made of, for example, a stainless steel.

For the purpose of improving operability, the roller drive shaft 270 may be configured to extend through the inside of the drive roller 27 in the axial direction, and the roller drive shaft 270 and the drive roller 27 may be fastened to each other in a front part (of the apparatus) by using a screw. In this case, however, a problem may occur if an environmental condition such as the temperature changes, because there is a difference in the coefficient of thermal expansion between the drive roller 27 and the roller drive shaft 270. That is, the screw may become loose when the length of the drive roller 27 becomes relatively shorter, and the axial tension in the screw increases when the length of the drive roller 27 becomes relatively longer. As a result, a fatigue failure is likely to occur over time.

To prevent such a problem, with the rotation shaft coupling structure according to the present exemplary embodiment, the coupling shaft 275 having a large length is inserted through the drive roller 27, and the drive roller 27 and the roller drive shaft 270 are coupled to each other in a rear part (of the apparatus near the driving source in this example). Moreover, one end (in this example, the front end) of the coupling shaft 275 is a free end that allows the coupling shaft 275 to extend and contract in the axial direction. As a result, the rotation shaft coupling structure is not influenced by a change in an environmental condition such the temperature and is stable over time without impairing operability.

To be specific, according to the present exemplary embodiment, the drive roller 27 is a substantially cylindrical hollow roller that is rotated by the drive motor 310 through a flywheel (not shown), a drive gear (not shown), the roller drive shaft 270, and the like. The flywheel is disposed on the rear side of the image forming apparatus body 1.

The drive roller 27 includes a drive roller body 27*c* made of aluminium, a rear coupling member 27*a* made of a stainless steel, and a front insertion member 27*b* made of a stainless steel. The rear coupling member 27*a* and the front insertion member 27*b* are respectively fitted into rear and front end portions of the drive roller body 27*c* so as to protrude outward in the axial direction. The rear coupling member 27*a* and the front insertion member 27*b* are rotatably supported by bearings (not shown).

An end portion 270*t* of the roller drive shaft 270 has a substantially frusto-conical shape. A cylindrical recessed portion 270*a* that is internally threaded is formed in the end portion 270*t* so as to be coaxial with the end portion 270*t*. A positioning pin 270*p* protrudes in the radial direction from substantially the center of the roller drive shaft 270 in the axial direction. The roller drive shaft 270 in inserted into the rear coupling member 27*a* such that the end portion 270*t* (recessed portion 270*a*) is located in an end portion (adjacent to the drive roller 27) of the rear coupling member 27*a*. The drive roller 27 extends between a frame 1F of the image forming apparatus body 1 and a frame 25F of the intermediate transfer unit and is rotatably supported by the frames 1F and 25F.

The coupling shaft 275 is a long shaft having a threaded end portion 275*a*, which mates with the internal thread formed in the recessed portion 270*a*, at one end thereof. A screw head 275*b* is formed at the other end (a front end) of the coupling shaft 275. The coupling shaft 275 is inserted into the drive roller 27 through the front insertion member 27*b* and the threaded end portion 275*a* is inserted into (screwed into) the recessed portion 270*a*.

As shown in a partially enlarged view indicated by a blank arrow, a V-shaped cutout 27V is formed at an end of the rear coupling member 27*a*. When the rear coupling member 27*a* is attached to the roller drive shaft 270 (the roller drive shaft 270 is inserted into the rear coupling member 27*a*), the positioning pin 270*p*, which protrudes in the radial direction of the roller drive shaft 270, abuts against the V-shaped cutout 27V, and thereby the positioning pin 270*p* is disposed at the bottom of the V-shaped cutout 27V. As a result, the drive roller 27 is positioned (the intermediate transfer unit 22 integrated with the drive roller 27 is positioned) in the axial direction. To improve the operability of positioning and coupling and to prevent vibration of the coupling shaft 275 when the coupling shaft 275 rotates, the inside diameter of the front insertion member 27*b* (for example, 9 mm (+0.1/0)) and the outside diameter of the coupling shaft 275 (for example, 9 mm (−0.05/−0.15)) are determined so that they are fitted together so as to overlap over a small length (for example, 3 mm) in the axial direction.

The coupling shaft 275 is inserted into the front insertion member 27*b* of the drive roller 27, the threaded end portion 275*a* is inserted (screwed) into the recessed portion 270*a* of the roller drive shaft 270, and thereby the positioning pin 270*p* is pressed against the bottom of the cutout 27V. As a result, the drive roller 27 and the roller drive shaft 270 are positioned relative to each other so that backlash does not occur, and at the same time, the roller drive shaft 270 and the coupling shaft 275 are coupled to each other so that backlash does not occur. That is, according to the present exemplary embodiment, positioning of the drive roller 27 (the intermediate transfer unit 22) and coupling of the roller drive shaft 270 are performed by using a single member, i.e., the rear coupling member 27*a*. Thus, the rear coupling member 27*a* contributes to reduction in the number of components and reduction in size and cost.

While the threaded end portion 275*a* of the coupling shaft 275 is joined to (screwed into) the roller drive shaft 270, the other end of the coupling shaft 275 is a free end that allows the coupling shaft 275 to extend and contract in the axial direction. Therefore, even when the lengths of the components change due to thermal expansion or the like, a coupled state is securely maintained without causing backlash and variation in rotation is reliably prevented over time by fully utilizing the functions of the flywheel and the like.

Figure 4A:
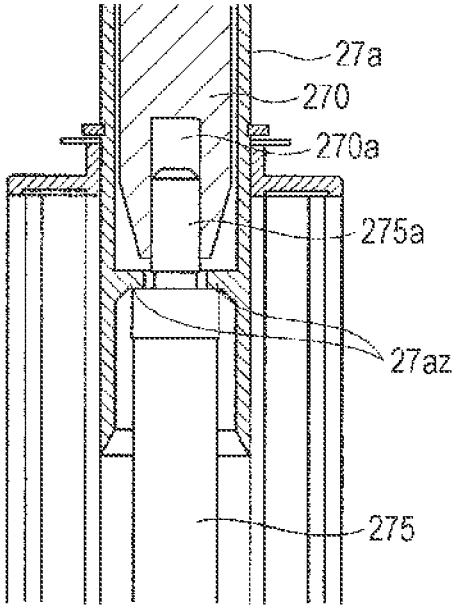
FIGS. 4A and 4B are schematic enlarged views illustrating comparative examples that are compared with the drive roller coupling structure according to the present exemplary embodiment.
Figure 4B:
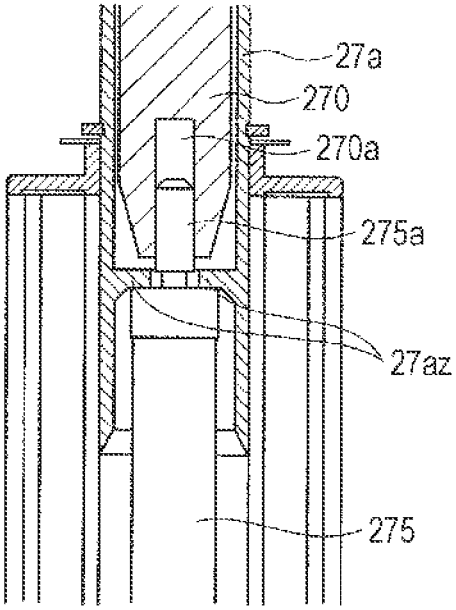

The inventors have found that the following problems may occur even when the roller drive shaft 270 is coupled to the drive roller 27 in a rear part by using the coupling shaft 275 having a large length. That is, if a bearing surface 27*az* extending perpendicularly to the axial direction is formed in a part of the rear coupling member 27*a* corresponding to a base end of the threaded end portion 275*a* as illustrated in FIG. 4A, the screws are likely to become loose because the area of the bearing surface 27*az*, which is limited by the inside diameter of the drive roller 27, is small. On the other hand, if the diameter of the threaded end portion 275*a* is reduced in order to increase the area of the bearing surface 27*az* as illustrated in FIG. 4B, breakage of the threaded end portion 275*a* is likely to occur over time.

Figure 5A:
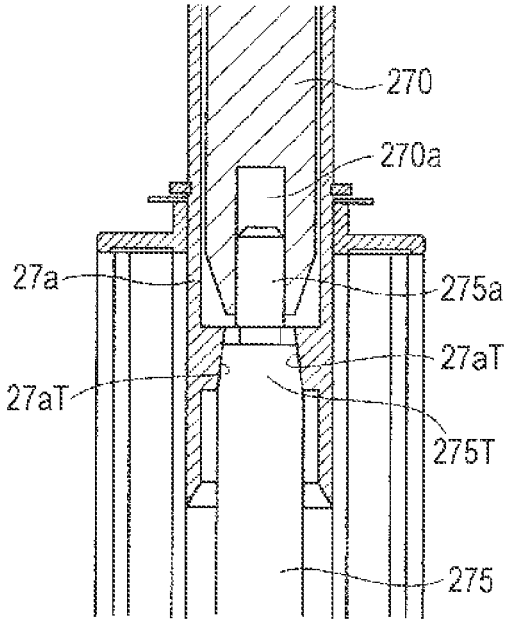
FIGS. 5A and 5B are schematic enlarged views illustrating the drive roller coupling structure according to the present exemplary embodiment.
Figure 5B:
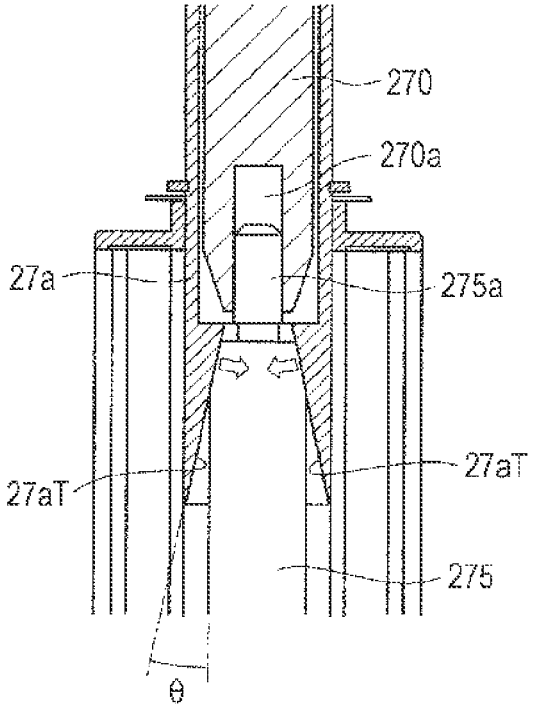

To prevent such problems, a rotation shaft coupling structure according to the present exemplary embodiment includes an inclined surface 275T and a shaft-peripheral contact surface 27*a*T as illustrated in FIGS. 5A and 5B. The inclined surface 275T is formed at a base end of the threaded end portion 275*a* of the coupling shaft 275 so as to extend outward in the radial direction from the base end in a substantially frusto-conical shape (tapered shape). The shaft-peripheral contact surface 27*a*T is formed on a corresponding inner peripheral surface of the rear coupling member 27*a* and has a surface profile that matches the surface profile of the inclined surface 275T. The shaft-peripheral contact surface 27*a*T contacts the inclined surface 275T of the coupling shaft 275 and covers the inclined surface 275T along the circumferential direction in a coupled state (when the threaded end portion 275*a* is screwed into the recessed portion 270*a* to a predetermined depth).

As illustrated in FIG. 5A, it is sufficient that the length of the shaft-peripheral contact surface 27*a*T in the axial direction be a length corresponding to the length of the inclined surface 275T of the coupling shaft 275 having a tapered shape. However, as illustrated in FIG. 5B, for the purpose of increasing ease of manufacturing and enhancing a guiding function, the shaft-peripheral contact surface 27*a*T may have a length larger than that of the shaft-peripheral contact surface 27*a*T in the axial direction, and the shaft-peripheral contact surface 27*a*T may extend to an end of the rear coupling member 27*a* (in a direction toward the drive roller 27).

With the rotation shaft coupling structure according to the present exemplary embodiment, when the coupling shaft 275 having a large length is inserted into the drive roller 27, the shaft-peripheral contact surface 27*a*T guides the threaded end portion 275*a* of the coupling shaft 275 toward the recessed portion 270*a* of the roller drive shaft 270 (functions as a guide), and thereby the operability is improved. Moreover, the contact area of the bearing surface (shaft-peripheral contact surface) is increased within the limited inside diameter of the drive roller 27, and thereby the coupled state is stabilized. In the coupled state (a state in which the shaft-peripheral contact surface 27*a*T and the inclined surface 275T are in contact with each other), a reaction force oriented in the direction from the shaft-peripheral contact surface 27*a*T of the rear coupling member 27*a* toward the axis of the coupling shaft 275, which is indicated by blank arrows in FIG. 5B, is generated, and fastening forces are applied to the coupling shaft 275*a* due to a wedge effect. As a result, the coupled state of the coupling shaft 275 is securely maintained over time.

For the purpose of effectively generating the fastening forces described above, the angle θ (see FIG. 5B) between the axis of the shaft-peripheral contact surface 27*a*T (inclined surface 275T) and the axis (central axis) may be small. However, if the angle θ is too small (for example, the shaft-peripheral contact surface 27*a*T is parallel to the axis), when the coupling shaft 275 is screwed into the recessed portion 270*a*, the threaded end portion 275*a* may become inserted too deeply into the recessed portion 270*a* and may contact the bottom portion of the recessed portion 270*a*, and may hinder positioning of the positioning pin 270*p* and the V-shaped cutout 27V. Therefore, the angle θ may be about 45°.

The technical scope of the present invention is not limited to the exemplary embodiment described above, and various modifications and improvements may be made within the spirit and scope of the present invention. For example, in the exemplary embodiment described above, the rotation shaft coupling structure according to the present invention is used for the drive roller 27 of the intermediate transfer unit 22. However, the rotation shaft coupling structure according to the present invention may be used for any rotary member that has a problem of variation in rotation, such as a roller of the fixing device.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A rotation shaft coupling structure comprising:

a roller drive shaft that is rotatable and that includes a recessed portion at an end thereof, the recessed portion having an internal thread formed therein;

a rotation roller having a hollow shape and including a coupling member at an end portion thereof in an axial direction, the coupling member housing the recessed portion of the roller drive shaft, the rotation roller being rotated by the roller drive shaft; and a coupling shaft extending through the rotation roller in the axial direction and including a threaded portion at a first end portion thereof in the axial direction, the threaded portion mating with the internal thread of the recessed portion, the coupling shaft coupling the roller drive shaft and the rotation roller to each other, wherein the first end portion of the coupling shaft in the axial direction is joined to the roller drive shaft and the rotation roller in the coupling member of the rotation roller, and a second end portion of the coupling shaft in the axial direction is a free end that allows the coupling shaft to extend and contract in the axial direction with respect to an adjacent end of the rotation roller.

2. The rotation shaft coupling structure according to claim 1, wherein the coupling shaft includes an inclined surface having a substantially frusto-conical shape and extending outward from a base end of the threaded portion of the coupling shaft in a radial direction, and a corresponding inner peripheral surface of the coupling member of the rotation roller includes a shaft-peripheral contact surface that has a surface profile matching a surface profile of the inclined surface and that contacts the inclined surface in a coupled state.

3. The rotation shaft coupling structure according to claim 1, wherein the coupling member of the rotation roller includes a positioning portion having a cutout shape, the positioning portion enabling positioning of the rotation roller by abutting against the roller drive shaft.

4. The rotation shaft coupling structure according to claim 2, wherein the coupling member of the rotation roller includes a positioning portion having a cutout shape, the positioning portion enabling positioning of the rotation roller by abutting against the roller drive shaft.

5. An intermediate transfer unit comprising:

an intermediate transfer belt that has an endless shape and that is rotatably looped over a plurality of rollers; and a drive roller that rotates the intermediate transfer belt through a flywheel, wherein the rotation shaft coupling structure according to claim 1 is used to couple the drive roller and a drive shaft for driving the drive roller to each other.

6. An image forming apparatus comprising:

an image forming unit that forms an image on a recording medium, wherein the rotation shaft coupling structure according to claim 1 is used to couple at least one rotary member and a drive shaft for driving the at least one rotary member to each other.

* * * * *